United States Patent [19]

Harvey

[11] Patent Number: 4,673,361

[45] Date of Patent: Jun. 16, 1987

[54] KAYAK/CANOE PADDLE

[76] Inventor: William P. Harvey, Undermountain Rd., Box 462, Salisbury, Conn. 06068

[21] Appl. No.: 820,425

[22] Filed: Jan. 17, 1986

[51] Int. Cl.[4] ..... B63H 16/04

[52] U.S. Cl. ..... 440/101; D12/215; 416/72

[58] Field of Search ..... 440/100, 101, 102, 104, 440/105, 106; 441/56; 416/72, 73, 74; D12/215

[56] References Cited

U.S. PATENT DOCUMENTS

| | | | |
|---|---|---|---|
| D. 186,252 | 9/1959 | Roberts | D12/215 |
| 826,693 | 7/1906 | Sheen | 440/101 |
| 1,003,069 | 9/1911 | Shea | 416/74 |
| 2,527,040 | 10/1950 | Swenson et al. | 416/74 |
| 2,913,727 | 11/1959 | Smith | D12/215 |
| 3,052,897 | 9/1962 | Martin | 9/24 |
| 3,068,498 | 12/1962 | Smith | 416/72 |
| 3,092,855 | 6/1963 | Smith | 416/72 |
| 4,233,925 | 11/1980 | Proctor | 440/101 |

FOREIGN PATENT DOCUMENTS

| | | | |
|---|---|---|---|
| 757954 | 5/1967 | Canada | 441/56 |
| 503378 | 6/1920 | France | 416/74 |
| 749730 | 7/1980 | U.S.S.R. | 440/101 |

*Primary Examiner*—Joseph F. Peters, Jr.
*Assistant Examiner*—Thomas J. Brahan
*Attorney, Agent, or Firm*—B. B. Olive

[57] ABSTRACT

An improved paddle for canoe or kayak recreational or competitive paddling incorporates crossbar structure formed such that when incorporated either with a single blade canoe paddle or with a double blade kayak paddle both hands grip available crossbars when stroking on either side of the canoe or kayak.

9 Claims, 8 Drawing Figures

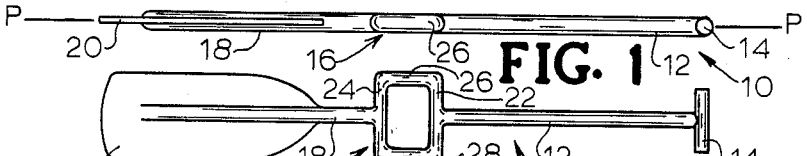
FIG. 1
FIG. 2
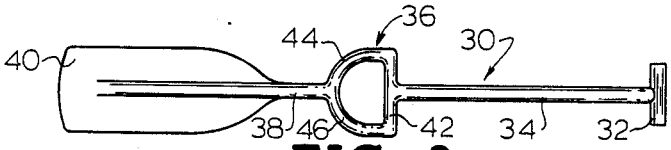
FIG. 3
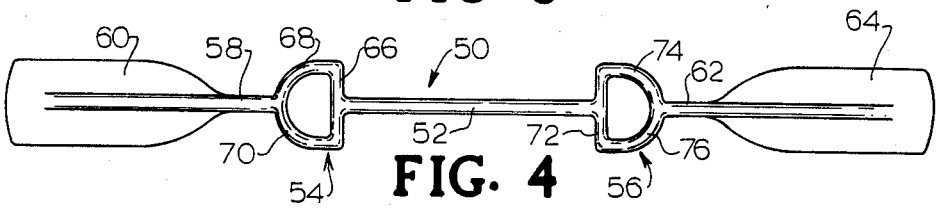
FIG. 4
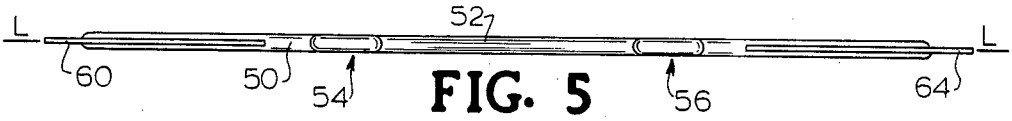
FIG. 5
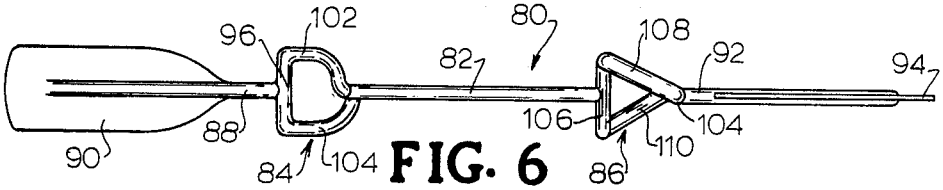
FIG. 6
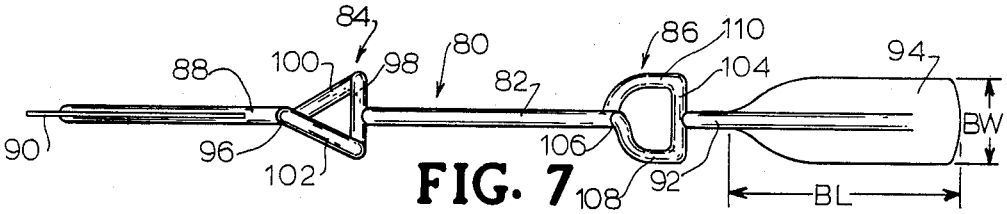
FIG. 7
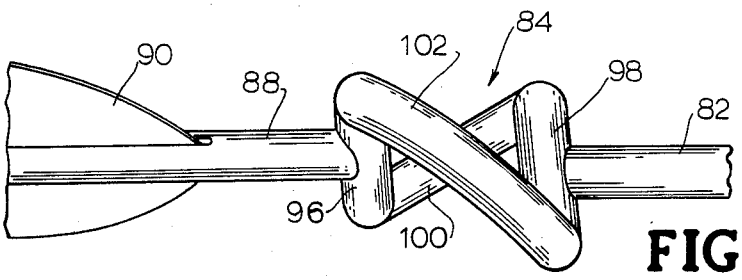
FIG. 8

KAYAK/CANOE PADDLE

DESCRIPTION

1. Technical Field

The invention relates to paddle constructions and particularly to those used for recreational and competitive canoe and kayak paddling.

2. Background Art

The typical kayak paddle in a so-called "feathered" construction comprises a pair of paddles mounted on opposite ends of a shaft generally of round cross section and with the planes of the paddle blades oriented in perpendicular relation to each other. The non-feathered kayak paddle follows the same construction except that the paddle blades reside in the same plane. For both types, the paddler asserts force on the paddle blade by gripping the shaft near the paddle blade being stroked with one hand while keeping the opposite hand spaced outwardly and gripping another portion of the same shaft.

In contrast to kayak paddle construction, the typical canoe paddle mounts a single paddle blade on one end of a shaft typically of round or elliptical cross section. A crossbar oriented perpendicular to the axis of the shaft mounts at the end of the shaft opposite the end on which the paddle blade is mounted. Thus, a conventional canoe paddle during stroking allows one hand to grip the shaft near the paddle blade and the other hand to grip the crossbar. It is recognized that in canoe paddling that the crossbar is of substantial assistance by providing a crossbar grip for one hand while the other hand is forced to grip the shaft with a pole grip. However, neither the conventional kayak paddle or the conventional canoe paddle is constructed so that both hands are able to grip a crossbar during paddling on either side of the canoe or the kayak. The provision of both a canoe paddle and a kayak paddle with this feature thus becomes the principal object of the invention. Other objects will become apparent as the description proceeds.

DISCLOSURE OF INVENTION

A paddle construction according to the invention provides both a single canoe paddle and a double kayak paddle construction enabling both hands to grip crossbars to substantially increase the pulling effort on the paddle. For canoe paddling, the improved paddle embodies a single loop handle incorporating either one or two crossbars and formed integral with a shaft. The loop handle with its one or two crossbars is located near the paddle blade at one end of the shaft and another crossbar is mounted at the opposite end of the shaft. For both feathered and non-feathered kayak paddles, the improved paddle embodies a loop handle incorporating either one or two crossbars located near and inward of each paddle blade and formed integral with a shaft extending between the loop handles. The unique crossbar construction enables both hands to grip crossbars when paddling on either side of the canoe or kayak.

DESCRIPTION OF DRAWINGS

FIG. 1 is a top view of a canoe paddle according to a first embodiment of the invention.

FIG. 2 is a side view of the canoe paddle of FIG. 1.

FIG. 3 is a side view representing a second embodiment of an improved canoe paddle according to the invention.

FIG. 4 is a side view of an improved non-feathered kayak paddle according to a third embodiment of the invention.

FIG. 5 is a top view of the kayak paddle of FIG. 4.

FIG. 6 is a side view of an improved feathered kayak paddle according to a fourth embodiment of the invention.

FIG. 7 is a side view of the kayak paddle of FIG. 6 in a rotated position.

FIG. 8 is partial perspective view of the left end of the paddle of FIG. 7 and with the paddle slightly rotated with respect to FIG. 7.

BEST MODE FOR CARRYING OUT THE INVENTION

Making reference to the drawings an improved canoe paddle 10 according to a first embodiment of the invention comprises an elongated shaft of round or other suitable cross section having one shaft section 12 extending between the suitably secured crossbar 14 and a closed loop handle 16. Another shaft section 18 axially aligned with shaft section 12 extends between loop handle 16 and a paddle blade 20. As best seen in FIG. 1, the plane of paddle blade 20 generally coincides with the central plane of loop handle 16 indicated by reference line P—P. The axis of crossbar 14 is perpendicular to the axis of shaft section 12 and resides in the same plane P—P. Loop handle 16 includes a first crossbar 22 parallel to crossbar 14, a second crossbar 24 parallel to crossbar 22 and connecting side bars 26–28. Crossbar 24 resides closer to blade 20 than does crossbar 22.

The improved paddle 10 illustrated in FIGS. 1 and 2 is useful for both recreational and competitive canoe paddling but is preferably used in a slightly different manner for competitive paddling than when used for recreational paddling. When paddle 10 is being used for recreational paddling on the left or port side of the canoe, the left hand grips bar 22 and the right hand grips crossbar 14. When paddling on the right or starboard side of the canoe in recreational paddling the right hand grips bar 22 and the left hand grips bar 14. Generally when a right handed person uses paddle 10 for competitive paddling the right hand grips crossbar 24 when paddling on the left or port side of the canoe and the left hand grips crossbar 14. When the competitive right handed paddler strokes on the right or starboard side of the canoe he will generally use the right hand to grip crossbar 22 and the left hand to grip crossbar 14. The left handed person may of course adjust according to his needs. With either the right handed or left handed competitive paddler a much stronger and more efficient paddling effort results.

For non-competitive recreational paddling a second embodiment improved paddle 30 shown in FIG. 3 embodies a crossbar 32 mounted on shaft section 34 integrally secured to an alternative form of closed loop handle 36 secured to shaft section 38 axially aligned with shaft section 34 and which in turn mounts an integrally formed paddle blade 40. As with the first embodiment, paddle blade 40 resides in the same general plane as the plane of loop handle 36. The axis of crossbar 32 is perpendicular to the axis of shaft 34 and also resides in the same plane as the plane of blade 40. Loop handle 36 connects to shaft section 38 with the curved side bars 44–46. Thus, only one crossbar 42 in addition to crossbar 32 is provided since it is contemplated that canoe paddle 30 will be used only for recreational paddling. Thus, when paddling on the port or left side of the canoe the left hand grips crossbar 42 and the right hand grips crossbar 32. Alternatively, when paddling on the starboard or right side of the canoe crossbar 32 is gripped by the left hand and crossbar 42 is gripped by the right hand. The dual crossgrip arrangement thus substantially improves the stroking force for both sides of the canoe.

Making reference next to FIGS. 4 and 5 there is illustrated an improved non-feathered kayak paddle 50 according to a third embodiment of the invention. Kayak paddle 50 includes a central shaft section 52, a pair of closed loop handles 54, 56, an outer shaft section 58 integrally secured to a paddle blade 60 and an outer shaft section 62 integrally secured to a paddle blade 64. As best illustrated in FIG. 5 the plane L—L of paddle blade 60 and 64 align with the central planes of loop handles 54, 56. The axes of axially aligned shaft sections 52, 58 and 62 reside in the same plane. Loop handle 54 includes crossbar 66 and inwardly curved connecting bars 68, 70. Loop handle 56 includes crossbar 72 and inwardly curved connecting bars 74, 76 connected to shaft section 62. The respective axis of crossbars 66, 72 are perpendicular to the axis of shaft section 52 and reside in previously referred to reference plane L—L. In use, the improved non-feathered kayak paddle 50 is used with the left hand gripping bar 66 and the right hand gripping crossbar 72 with no change in hand position when changing from paddling on the port or left side of the kayak or on the starboard or right side of the kayak. That is, the hand positions do not shift. However, in all positions it will be noted that both hands have the advantage of gripping crossbars during kayaking and thus maximum paddling force is achieved.

In a fourth embodiment illustrated in FIGS. 6, 7 and 8, an improved feathered kayak paddle 80 is provided with a modified form of loop handle different from those previously described and operative in a unique manner particularly for competitive paddling. Improved handle 80 includes a central shaft section 82 extending between a closed loop handle 84 and a closed loop handle 86. Loop handle 84 in turn connects to shaft 88 axially aligned with shaft section 82 and integrally formed with paddle 90. Loop handle 86 connects to shaft section 92 axially aligned with shaft section 82 and integrally formed with paddle blade 94. The plane of paddle blade 94 is oriented substantially perpendicular to the plane of paddle blade 90, thus, a feathered kayak paddle construction is achieved. If desired, blades 94 and 90 could have a less than 90° orientation. The construction of loop handles 84 and 86 is believed to be particularly unique. In this regard it will be noticed that loop handle 84 includes a crossbar 96 whose axis is perpendicular to shaft section 88 and resides generally in the same plane as the plane of paddle blade 90 as best seen in FIG. 7. Loop handle 84 further includes a crossbar 98 secured to central shaft 82 with the axis of crossbar 98 being perpendicular to the axis of shaft 82. The axis of crossbar 98 is oriented 90° with respect to the axis of crossbar 96 and curved connecting bars 100, 102 extend between the pair of crossbars 96, 98. Loop handle 86 is of similar construction and includes a crossbar 104 the axis of which is generally in the same plane as the plane of paddle blade 94 as best seen in FIG. 6. Loop handle 86 also includes a crossbar 106 which is oriented 90° with respect to crossbar 104. Crossbars 104 and 106 are connected by curved connecting bars 108, 110.

In using the feathered kayak paddle 80 illustrated in FIGS. 6–8, when paddling on the starboard or right side of the kayak the fingers of the right hand grip the crossbar 104 which is closest to paddle blade 94 and the fingers of the left hand grip the crossbar 98 and the paddling stroke is thus made with both hands operating on crossbars with full crossbar effect. When paddling on the port or left side of the kayak the left hand is quickly shifted from gripping bar 98 to gripping bar 96 and the right hand grip shifts from gripping crossbar 104 to gripping crossbar 106. It has been found that this transition can be learned very quickly and effectively improves the force of the paddling stroke particularly for competitive kayaking. Again, it will be noticed as with all of the previously explained embodiments both port and starboard stroking are accomplished with both hands gripping a crossbar and so far as is known has not been possible with any previously known paddle construction.

In all embodiments the central axis of the improved paddle passes through the single blade or double paddle blades, through the center of each of the crossbars and through each of the shaft sections. The illustrated improved paddles are preferably molded of an integral sturdy plastic construction or may be molded of a metal such as aluminum or formed with any of the recently made available carbon composites or other similar materials. Each paddle blade is preferably located only a few inches, e.g., about 4 inches from its nearest loop handle. Each blade mounting shaft section is substantially shorter than both the blade and the remaining shaft section of the single blade canoe paddle or the central shaft of the kayak paddle. The overall length and size of the paddles will conform to personal preference, customary practices and contest rules in the case of competitive racing.

In one embodiment of paddle 80, central shaft section 82 was made approximately 32 inches long, shaft sections 88 and 92 were made approximately $3\frac{1}{2}$ inches long, blades 90, 94 had an approximate length BL of 18 inches, width BW of 8 inches, and shaft sections 88, 82 and 96 were of round cross section of approximately $1\frac{3}{8}$ inches in diameter. While all embodiments are illustrated with blades of relatively flat construction the invention readily lends itself to blades having some degree of curvature in the plane of the blade. It will be seen however that with all embodiments and irrespective of exact size or exact paddle blade shape there is the improved advantage of both hands having a crossbar structure available for increased paddling effect and particularly for competitive paddling thus adding immeasurably to the thrill of racing.

What is claimed is:

1. An integrally constructed paddle comprising:

(a) a first paddle blade;

(b) a first shaft fixedly mounting said blade at one end thereof;

(c) a first handle structure, said first handle structure being fixedly mounted at an opposite end of said first shaft and including at least one first crossbar forming part of said handle structure and with the axis thereof oriented perpendicular to the axis of said first shaft;

(d) a second shaft substantially longer than said first shaft fixedly secured to said first crossbar and forming a continuation of and in axial alignment with said first shaft; and (e) a second crossbar having its axis oriented perpendicular to the axis of said second shaft and fixedly secured thereto at a position spaced outwardly from said first crossbar.

2. An integrally constructed paddle as claimed in claim 1 wherein:

(a) said first handle structure comprises an integral closed loop handle;

(b) said blade is of relatively flat construction; and (c) said second crossbar axis resides in the same plane as the plane of said first blade.

3. An integrally constructed paddle as claimed in claim 1 wherein:

(a) said first handle structure includes a third crossbar formed as an integral part of said handle structure and parallel to said first crossbar;

(b) said third crossbar is fixedly secured to an end of said first shaft opposite to the end to which said blade is secured; and (c) said first, second and third crossbars are parallel.

4. An integrally constructed paddle as claimed in claim 3 wherein:

(a) said first handle construction comprises a closed loop handle;

(b) said blade is of relatively flat construction; and (c) said first, second and third crossbars each have the axis thereof residing in the plane of said first blade.

5. An integrally constructed paddle as claimed in claim 1 wherein:

(a) said second crossbar is fixedly secured to an end of said second shaft opposite to the end to which said first crossbar is secured; and (b) said first and second crossbars are parallel.

6. An integrally constructed paddle as claimed in claim 1 wherein:

(a) said second crossbar is formed as an integral part of a second handle structure secured to the end of said second shaft opposite to the end to which said first crossbar is secured;

(b) said paddle includes a third shaft substantially equal in length to the length of said first shaft and fixedly secured to said second handle structure at one end and axially aligned with said first and second shafts; and (c) a second paddle blade fixedly secured to an opposite end of said third shaft.

7. An integrally constructed paddle as claimed in claim 6 wherein:

(a) said first and second handle structures comprise closed loop handles;

(b) said first and second blades reside in a common plane to provide an unfeathered type paddle;

(c) said first and second blades are of relatively flat construction; and (d) said first and second crossbars are parallel and have the axis thereof residing in the same plane as the plane of said first and second paddles.

8. An integrally constructed paddle as claimed in claim 6 wherein:

(a) said first and second blades are oriented in planes substantially perpendicular to each other to provide a feathered type paddle;

(b) said first and second handle structures comprise closed loop handles; and (c) said first and second crossbars are oriented substantially perpendicular to each other.

9. An integrally constructed paddle comprising:

(a) a first paddle blade of relatively flat construction;

(b) a first shaft fixedly mounting said blade at one end thereof;

(c) a first closed loop handle structure, said first handle structure being fixedly mounted at an opposite end of said first shaft and including at least one first crossbar oriented substantially perpendicular to the plane of said first blade and forming part of said handle structure and with the axis thereof oriented perpendicular to the axis of said first shaft;

(d) a second shaft substantially longer than said first shaft secured to said first crossbar and forming a continuation of and in axial alignment with said first shaft;

(e) a second crossbar oriented perpendicular to said first crossbar and having its axis oriented perpendicular to the axis of said second shaft and fixedly secured thereto at a position spaced outwardly from said first crossbar, said second crossbar being formed as part of a second closed loop handle structure fixedly secured to the end of said second shaft opposite to the end to which said first crossbar is secured;

(f) a third shaft substantially equal to the length of said first shaft and fixedly secured to said second handle structure at one end and axially aligned with said first and second shafts;

(g) a second paddle blade of relatively flat construction fixedly secured to an opposite end of said third shaft, said first and second blades being oriented in planes substantially perpendicular to each other to provide a feathered type paddle, said second crossbar in said second closed loop handle being oriented substantially perpendicularly to the plane of said second blade;

(h) said first closed loop handle including a third crossbar oriented to reside in the same plane as the plane of said first blade and located closer to said first blade than said first crossbar; and (i) said second closed loop handle including a fourth crossbar oriented to reside in the same plane as the plane of said second blade and located closer to said second blade than said second crossbar.

* * * * *